US007010136B1

(12) United States Patent
Roberts et al.

(10) Patent No.: US 7,010,136 B1
(45) Date of Patent: Mar. 7, 2006

(54) RESONANT RESPONSE MATCHING CIRCUIT FOR HEARING AID

(75) Inventors: Randall W. Roberts, Eden Prairie, MN (US); David A. Preves, Minnetonka, MN (US); Mark A. Bren, Laretto, MN (US)

(73) Assignee: Micro Ear Technology, Inc., Plymouth, MN (US)

( * ) Notice: Subject to any disclaimer, the term of this patent is extended or adjusted under 35 U.S.C. 154(b) by 0 days.

(21) Appl. No.: 09/251,592

(22) Filed: Feb. 17, 1999

(51) Int. Cl.
*H04R 25/00* (2006.01)

(52) U.S. Cl. ..... 381/320; 381/321; 381/317

(58) Field of Classification Search ..... 381/320, 381/321, 312, 316, 317, 318, 83, 93, 95, 381/23.1
See application file for complete search history.

(56) References Cited

U.S. PATENT DOCUMENTS

| | | | | | |
|---|---|---|---|---|---|
| 2,112,569 | A | * | 3/1938 | Lybarger | 381/320 |
| 2,308,931 | A | * | 1/1943 | Penn | 381/320 |
| 3,527,901 | A | | 9/1970 | Geib | |
| 4,366,349 | A | | 12/1982 | Adelman | 179/107 |
| 4,396,806 | A | | 8/1983 | Anderson | 179/107 |
| 4,419,544 | A | | 12/1983 | Adelman | 179/107 |
| 4,471,490 | A | | 9/1984 | Bellafiore | 381/69 |
| 4,637,402 | A | | 1/1987 | Adelman | 128/746 |
| 4,689,819 | A | * | 8/1987 | Killion | 381/321 |
| 4,882,762 | A | | 11/1989 | Waldhauer | |
| 5,044,373 | A | * | 9/1991 | Northeved et al. | 600/559 |
| 5,243,662 | A | * | 9/1993 | Sogn et al. | 381/420 |
| 5,263,089 | A | * | 11/1993 | Ribic | 381/320 |
| 5,390,254 | A | | 2/1995 | Adelman | 381/68 |
| 5,406,633 | A | * | 4/1995 | Miller et al. | 381/320 |
| 5,434,924 | A | | 7/1995 | Jampolsky | 381/68.4 |
| 5,502,769 | A | | 3/1996 | Gilbertson | 381/68 |
| 5,553,152 | A | | 9/1996 | Newton | 381/68.6 |
| 5,581,747 | A | | 12/1996 | Anderson | 395/551 |
| 5,659,621 | A | | 8/1997 | Newton | 381/68 |
| 5,710,820 | A | * | 1/1998 | Martin et al. | 381/321 |
| 5,757,933 | A | | 5/1998 | Preves et al. | 381/68 |
| 5,822,442 | A | | 10/1998 | Agnew et al. | 381/107 |
| 5,825,631 | A | | 10/1998 | Prchal | 361/790 |
| 5,835,611 | A | | 11/1998 | Kaiser et al. | 381/321 |
| 5,852,668 | A | | 12/1998 | Ishige et al. | 381/312 |
| 5,862,238 | A | | 1/1999 | Agnew et al. | 381/321 |
| 6,041,129 | A | | 3/2000 | Adelman | 381/328 |
| 6,236,731 | B1 | | 5/2001 | Brennan et al. | 381/316 |
| 6,240,192 | B1 | | 5/2001 | Brennan et al. | 381/314 |

(Continued)

FOREIGN PATENT DOCUMENTS

WO WO-00/21332 4/2000

OTHER PUBLICATIONS

Smriga, David J. Exploring the Versatility of Three-Channel Programmability Hearing Instruments, vol. 42, No. 6 (Jun. 1991). p. 14. (supplied by Applicant in IDS of Aug. 1, 2000).*

(Continued)

*Primary Examiner*—Xu Mei
(74) *Attorney, Agent, or Firm*—Schwegman, Lundberg, Woessner & Kluth P.A.

(57) ABSTRACT

An apparatus for and method of employing an electronic hearing aid device to assist a hearing impaired patient. The resonance curve of the outer auditory canal of the patient is determined. A device in accordance with the present invention is tuned to a frequency response curve which matches the measured resonance curve. The device is tuned by adjusting the overshoot of a low pass filter stage which is interposed between the microphone input and a class D output stage.

20 Claims, 4 Drawing Sheets

U.S. PATENT DOCUMENTS

| | | | | |
|---|---|---|---|---|
| 6,347,148 | B1 | 2/2002 | Brennan et al. | |
| 6,366,863 | B1 | 4/2002 | Bye et al. | 702/57 |
| 6,389,142 | B1 | 5/2002 | Hagen et al. | 381/313 |
| 6,449,662 | B1 | 9/2002 | Armitage | 710/8 |
| 2001/0007050 | A1 | 7/2001 | Adelman | 600/150 |
| 2002/0076073 | A1 | 6/2002 | Taenzer et al. | 381/315 |

OTHER PUBLICATIONS

Trump, Bruce and Stitt, Mark. 'MFB Low-Pass Filter Design Program' AB-034B. [online] Burr-Brown Corporation. 1993 [retrieved on Feb. 10, 2005]. Retrieved from the Internet: <URL: http://www.stanford.edu/class/ee122/Handouts/filter_ design.pdf> pp. 1-6.*

Lacanette, Kerry. 'A Basic Introduction to Filters—Active, Passive, and Switched-Capacitor' AN-779. [online] National Semi. 1995 [retrieved on Feb. 10, 2005]. Retrieved from the Internet: <URL:http://www.swarthmore.edu/NatSci/echeeve1/ Ref/DataSheet/introtofilters.pdf>.*

Trofimenkoff et al. 'Noise Perfromance of RC-Active Quadratic Filter Sections' [online] IEEE Trans on Circuit Theory, vol. 20, No. 5, Sep. 1973 [retrieved on Feb. 10, 2005] Retrieved from the Internet: <URL:http://ieeexplore.ieee.org/iel5/8147/23429/01083-730.pdf> (01083730.pdf).*

'How to Use the LS509 based GS3010 Hybrid' Application Note [online] Gennum Corp. 1993 [Retrieved on Feb. 21, 2005]. Retrieved from the Internet: <URL: http://www.gennum.com/hip/pdffiles/52080DOC.pdf>. pp. 1-3.*

'Active Filtering for Hearing Aids' Technical Paper [online] Gennum Corp. 1981 [Retrieved on Feb. 22, 2005]. Retrieved from the Internet: <URL: www.gennum.com/hip.pdffiles/60009DOC.pdf>. pp. 1-2.*

'Low Current Quad Inverting Amplifiers—LX509 Data Sheet' [online] Gennum Corp. 1988, Revised Jan. 2001 [Retrieved on Feb. 21, 2005]. Retrieved from the Internet: <URL: http://www.gennum.com/hip/pdffiles/51030DOC.pdf>. pp. 1-3.*

'GL504-GH580, GK504-GH580' Application Note [online] Gennum Corp. 1993 [Retrieved on Feb. 21, 2005] Retrieved from the Internet: <URL: http://www/gennum.com/hip/pdffiles/52071DOC.pdf>. pp. 1, 8-10.*

Agnew, J., "Advances in Programmable canal hearing instrument technology", *Hearing Instruments,* vol. 43, No. 1, XP 000291315, 18-20, (Feb. 1, 1992).

Punch, J., et al., "A Recommended protocol for prescriptive use of target gain rules", *Hearing Instruments*, vol. 41, No. 4, XP000137439, 12, 14, 16, 18, (Apr. 1, 1990).

Smriga, D.J., "Exploring the versatility of three-channel programmability", *Hearing Instruments*, vol. 42, No. 6, XP000219540, 14, 16, 17, (Jun. 1, 1991).

Griffing, Terry S., et al., "Acoustical Efficiency of Canal ITE Aids", *Audecibel,* (Spring 1983), 30-31.

Griffing, Terry S., et al., "Custom canal and mini in-the-ear hearing aids", *Hearing Instruments*, vol. 34, No. 2, (Feb. 1983), 31-32.

Griffing, Terry S., et al. "How to evaluate, sell, fit and modify canal aids", *Hearing Instruments*, vol. 35, No. 2, (Feb. 1984), 3 pgs.

Mahon, William J., "Hearing Aids Get a Presidential Endorsement", *The Hearing Journal,,* (Oct. 1983), 7-8.

Sullivan, Roy F., "Custom canal and concha hearing instruments: A real ear comparison", *Hearing Instruments*, vol. 40, No. 4, (Jul. 1989), 5 pgs.

Sullivan, Roy F., "Custom canal and concha hearing instruments: A real ear comparison Part II", *Hearing Instruments*, vol. 40, No. 7, (Jul. 1989), 6 pgs.

* cited by examiner

RESONANT RESPONSE MATCHING CIRCUIT FOR HEARING AID

BACKGROUND OF THE INVENTION

1. Field of the Invention

The present invention relates generally to a circuit for and method of processing an audio frequency signal and more particularly relates to hearing aid signal processing.

2. Description of the Prior Art

It is well known in the art to utilize electronic devices to assist the hearing impaired. The earliest such instruments consisted of a microphone coupled to an electronic amplifier which was in turn coupled to an earphone. Quite apart from the technical difficulties experienced, these early hearing aids were sufficiently large and intrusive that the hearing impaired could be readily identified providing a degree of self-consciousness.

The coming of electronic miniaturization and sub-miniaturization permitted the manufacture of hearing aid systems which are totally inserted in the outer auditory canal during use. The resulting systems provide substantially greater hearing assistance along with a much more pleasing (and almost unnoticeable) aesthetic appearance. A modern, totally in-the-ear device has a microphone acoustically coupled to the ambient with all of the electronics packaged in a form factor which is accommodated by the outer ear of the patient. A transducer is electronically coupled to the output stage of the hearing aid circuit and acoustically coupled to the distal portion of the outer auditory canal.

U.S. Pat. No. 4,689,818, issued to Ammitzboll on Aug. 25, 1987, purports to describe the circuitry and operation of the Siemens Custom In-The-Ear Hearing Aid 007, sold by Siemens Hearing Instruments, Inc. This is a typical example of a totally in-the-ear device.

A key problem in the miniaturization process is reducing the size of the battery. Whereas substantial progress has been made in battery development, much credit is also appropriately given to designers of low power consumption electronic circuitry. Current state of the art instruments utilize class D output stages which are particularly helpful in reducing overall power consumption. However, as is known to those of skill in the art, the class D output stage tends to have a frequency response curve whose peak gain frequency is not easily modified to accommodate differences in patient pathologies. Yet, abnormalities in middle ear functioning are known to shift the peak in the unaided ear canal resonance to a lower frequency.

SUMMARY OF THE INVENTION

The present invention overcomes the disadvantages of the prior art by providing a technique for utilizing the power saving characteristics of a class D output stage within a system which has sufficient adjustability in frequency response peak gain frequency to accommodate various differences in patient-to-patient middle ear pathology. Specifically, the present invention employs an active low-pass filter which has adjustable overshoot. This filter is coupled through a buffering stage to the class D output amplifier. By adjusting the degree of overshoot, the level of the peak in the frequency response of the entire system is readily adjustable within a given therapeutic range even though the class D output amplifier is inherently difficult to tune.

When practicing the present invention, the resonance curve of the outer auditory canal of the patient is determined utilizing existing techniques. This curve is relatively consistent for patients having normal ear physiology. However, various middle ear pathologies often lower the frequency of the basic resonance producing a unique frequency response curve for a given patient.

In accordance with the present invention, the overshoot of the low pass filter stage is adjusted such that the frequency response curve of the hearing aid system most nearly matches the resonance curve of the patient's outer auditory canal. Thus, when the hearing aid is properly inserted, the resulting interface between the hearing assistance device and the patient's middle ear are very closely correlated.

As a result of this frequency response match, the patient is provided with a smooth insertion frequency response without extra amplification at the frequency of the ear canal resonance. The advantages of lower power consumption, lessened probability of acoustic feedback, and improved auditory acuity are the direct products of practicing the present invention.

In a preferred mode of practicing the present invention and not to be deemed to be limiting of the scope of the invention, the output of the preamp or signal processing stage is applied to a standard R-C circuit. The resulting signal is coupled through a variable resistor to an amplifying stage, wherein the resistance variability adjusts the overshoot. The active low pass filter output is capacitively coupled to a buffering stage employing a normal operational amplifier. The output of the buffering stage is applied directly to the class D output amplifier.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE INVENTION

The present invention is described in accordance with several preferred embodiments which are to be viewed as illustrative without being limiting. In the preferred mode, the present invention is employed as a totally within the ear hearing aid system having a class D output stage.

Figure 1:
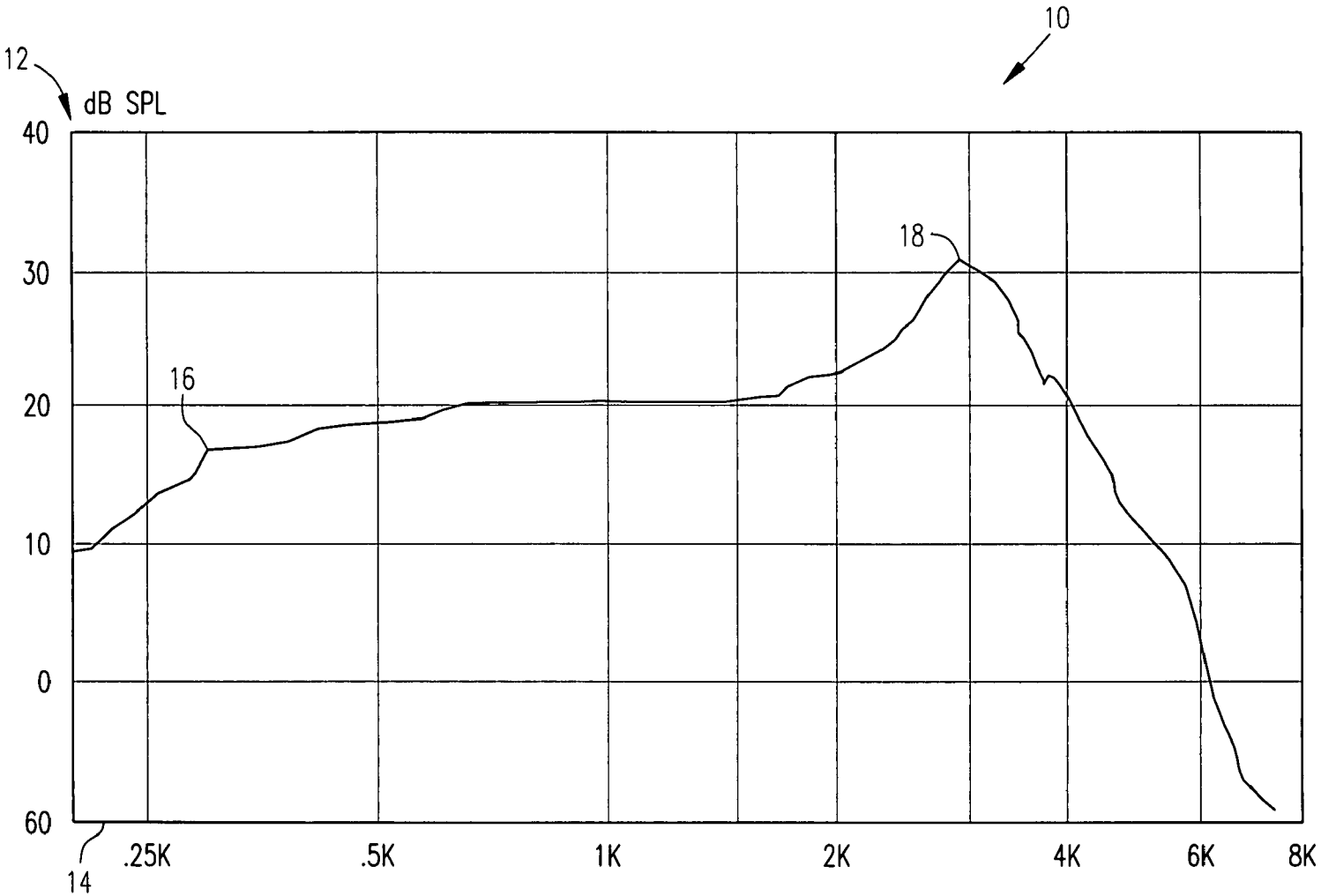
FIG. 1 is the 2 cc coupler frequency response of a typical ITE hearing aid with a class D output stage in the hearing aid receiver.

FIG. 1 is diagram 10 showing the 2 cc coupler frequency response of a typical ITE hearing aid with a class D output stage in the hearing aid receiver. Abscissa 14 is a logarithmic plot of frequency in kilohertz. Ordinate 12 shows the gain at each frequency plotted in decibels.

In a patient having normal middle ear physiology, the ear canal can be thought of as an open organ pipe having a primary resonance at about 2.8 kilohertz and a relatively flat response from about 300 hertz to about 3 kilohertz. As shown in diagram 10, gain curve 16 for the hearing aid is deliberately designed to match this response to replace the peak in gain lost when the ear canal is occluded by an ear mold. Gain peak 18 occurs at about 2.8 kilohertz.

Figure 2:
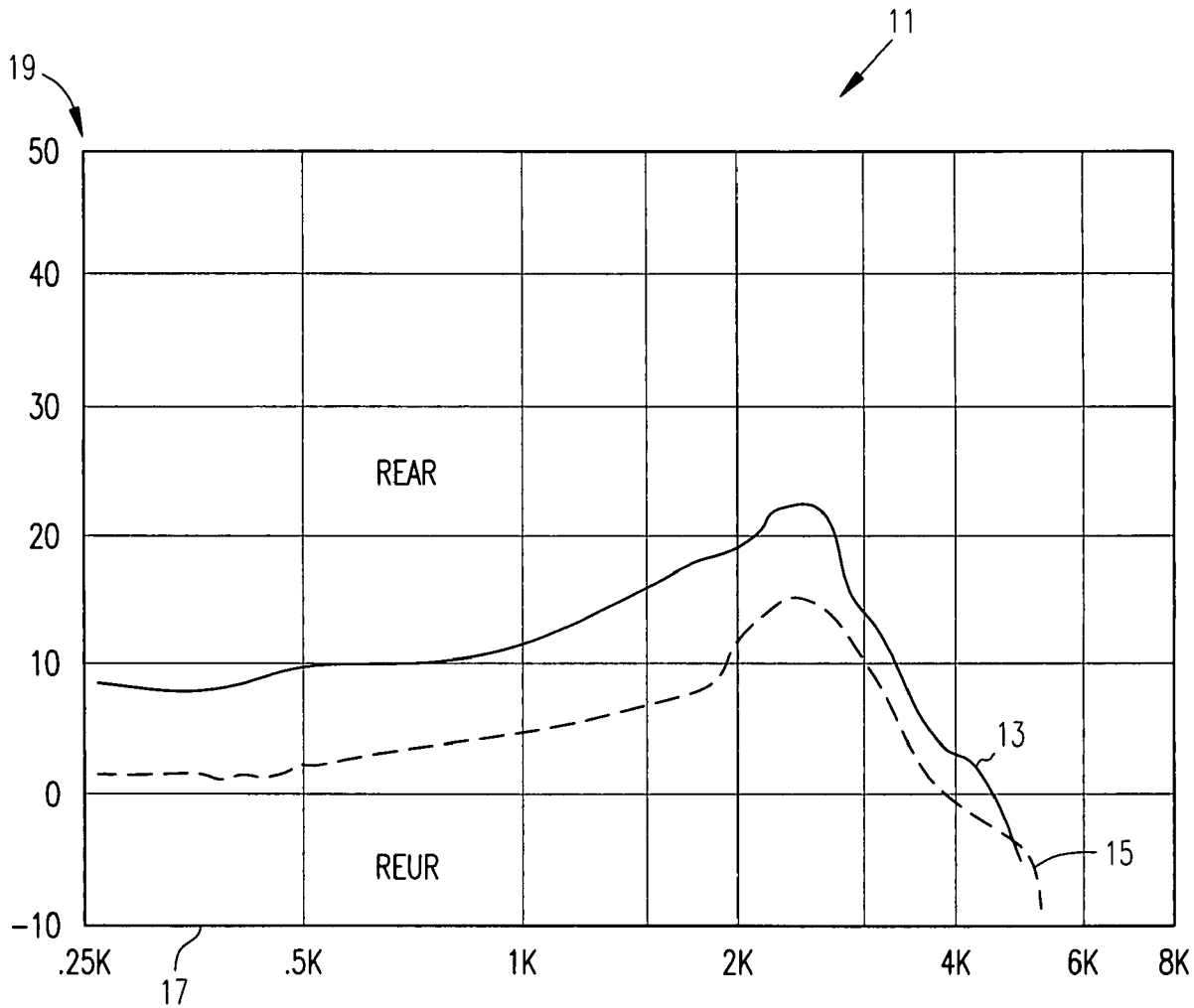
FIG. 2 are real ear IG frequency response curves in: a) the unoccluded outer auditory canal of a patient with normal middle ear function (REUR—bottom) and b) with the hearing aid of FIG. 1 (REAR—top)

FIG. 2 is diagram 11 showing the real ear IG frequency response curves in: a) the unoccluded outer auditory canal of a patient with normal middle ear function (bottom) and b) with the hearing aid of FIG. 1 (top). The bottom curve is a typical resonance curve of the unoccluded outer auditory canal (REUR) of a patient having normal middle ear physiology. Abscissa 17 is a logarithmic plot of frequency in kilohertz. Ordinate 19 shows the resonance at each frequency plotted in decibels. The top curve is the typical real ear output of the hearing aid of FIG. 1 in the ear canal whose unaided ear canal response is shown by the REUR curve.

As explained above, the ear canal can be thought of as an open organ pipe having a primary resonance at about 2.8 kilohertz and a relatively flat response from about 300 hertz to about 3 kilohertz. As shown in diagram 11, REUR curve 15 shows the resonance curve for the typical patient. Resonance peak occurs at about 2.8 kilohertz.

For a hearing impaired patient having a totally in-the-ear hearing aid device, the outer auditory canal is totally or partially blocked thus removing the natural resonance at resonance peak 18. However, it is typical that the class D amplifiers employed in current devices deliberately have a corresponding response peak at about 2.8 kilohertz (see also FIG. 1). Thus, the totally in-the-ear hearing aid device having the class D amplifier can easily provide hearing assistance with a response similar to the non-hearing impaired ear as shown by REAR curve 13.

Figure 3:
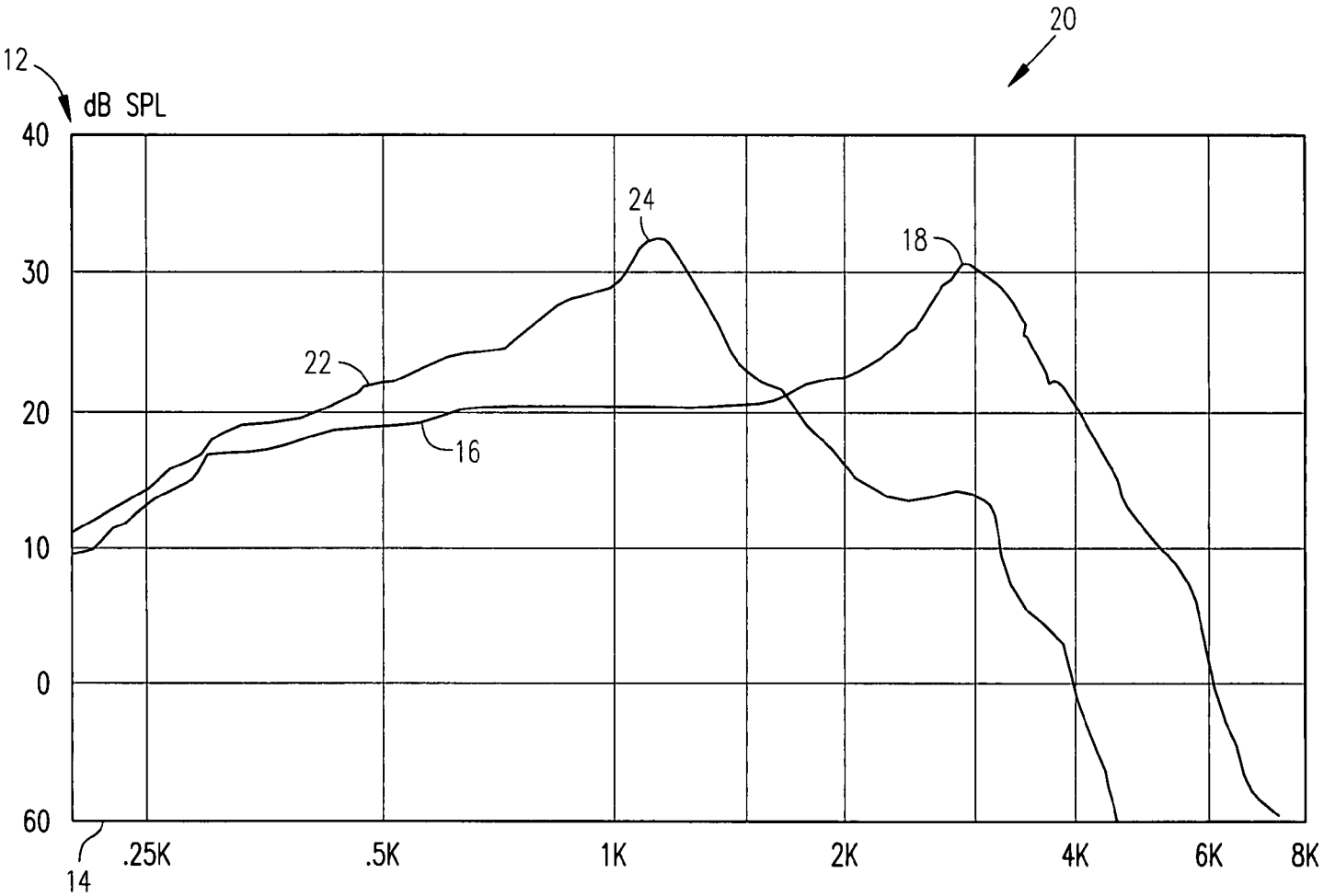
FIG. 3 is the response curve of FIG. 1 superimposed over the response curve shifted with the active low pass filter for a patient with abnormal middle ear pathology.

FIG. 3 is a diagram 20 showing a 2 cc coupler response curve 16 of FIG. 1 superimposed upon shifted response curve in a 2 cc coupler 22 for a patient having a typical middle ear pathology which lowers the primary resonance of resonance curve 22 to resonance peak 24. For this example, peak 24 occurs at about 1.2 kilohertz.-8—8-

A number of various problems can cause this lowering of the resonance of the outer auditory canal including punctured ear drum, abnormal middle ear bone physiology, etc. If a standard totally in-the-ear hearing aid device, having a class D output amplifier, is utilized in the patient of resonance curve 22, there will be a substantial mismatch in the frequency response curve of the hearing aid device and that of the open ear of the patient.

This mismatch renders most hearing aids incapable of providing enough amplification at the abnormally low resonant peak of frequency of the patient. The result is under-amplification at this frequency and a jagged insertion gain frequency response.

Figure 4:
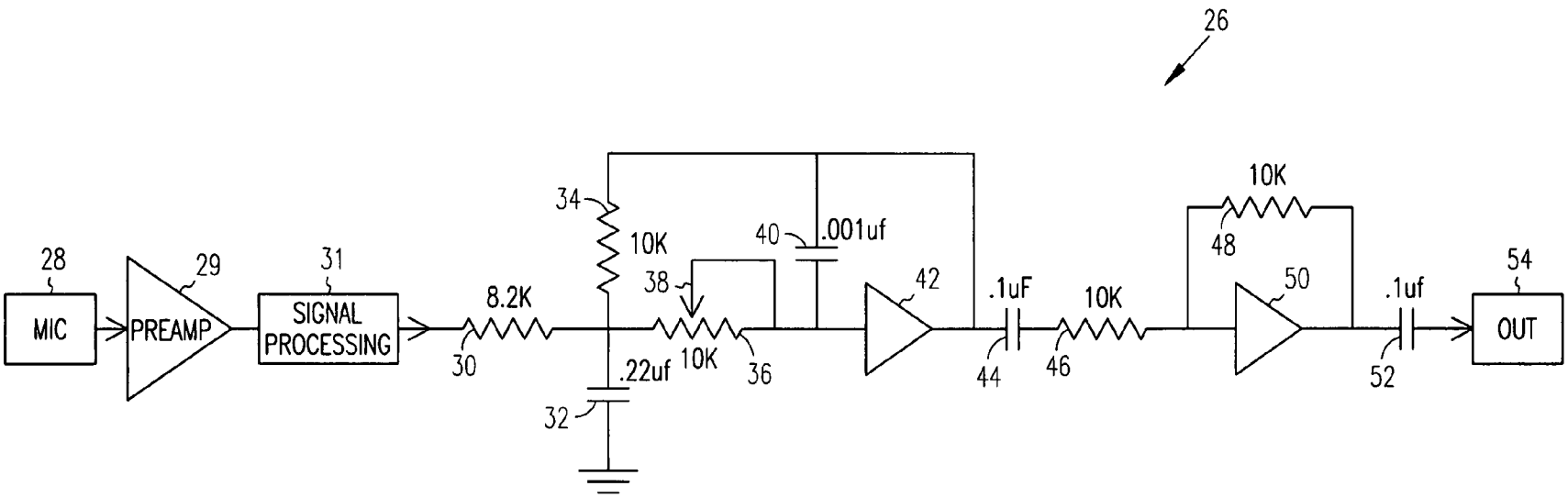
FIG. 4 is a detailed electronic schematic diagram of the signal processing circuit of the preferred mode of the present invention.

FIG. 4 is a detailed electronic schematic diagram 26 showing the critical circuitry of the preferred mode of the present invention. To properly practice the invention, the unaided ear canal resonance curve (REUR) of a given patient is obtained by measurement in accordance with standard procedures and the circuit of the present invention is tuned to match this measured resonance curve, before the device is released to the patient for use.

Microphone 28 is a standard hearing aid microphone acoustically coupled to the ambient. The signal produced by microphone 28 is coupled through standard preamplifier 29 and standard signal processing stage 31 to the low pass filter consisting of resistor 30 and capacitor 32. Variable resistor 38 couples the filtered signal to operational amplifier 42 and forms another pole of the low pass filter with capacitor 40. In this way, variable resistor 38 controls the amplification gain of the overshoot and the peak frequency of the low pass filter. Thus, variable resistor 38 controls frequency of peak gain in the frequency response curve of the entire hearing aid system.

The processed audio frequency signal is capacitively coupled via capacitor 44 to operational amplifier 50 via resistor 46. Resistor 48 provides feedback for operational amplifier 50 which functions as a buffering stage between the active low pass filter stage and the class D output amplifier.

The output of operational amplifier 50 is capacitively coupled via capacitor 52 to standard class D output amplifier 54.

Having thus described the preferred embodiments of the present invention, those of skill in the art will be readily able to adapt the teachings found herein to yet other embodiments within the scope of the claims hereto attached.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. An electronic device for use in assisting a hearing impaired patient having a microphone, a preamp, a signal processing stage, and an output amplifier, the electronic device comprising:

an active low pass filter responsively coupled between said signal processing stage and said output amplifier, said active low pass filter having an adjustable overshoot adapted to tunably match a measured resonance curve to provide a substantially smooth insertion gain frequency response, said active low pass filter including:

a resistor coupled to a capacitor to form a low pass filter to provide a filtered signal;

an operational amplifier to receive the filtered signal at an input of the operational amplifier;

a feedback capacitor coupled from an output of the operational amplifier to the input of the operational amplifier; and a variable resistor to couple the low pass filter to the input of the operational amplifier, wherein said active low pass filter is adapted to provide a frequency of peak gain of the electronic device.

2. The electronic device of claim 1, wherein said output amplifier further comprises a class D amplifier.

3. The electronic device of claim 2, further comprising a buffer stage responsively coupled intermediate said active low pass filter and said output amplifier.

4. The electronic device of claim 3, wherein the measured resonance curve corresponds to a resonance curve of an outer auditory canal of a hearing impaired patient.

5. The electronic device of claim 4, wherein said buffer stage is coupled to said active low pass filter by a coupling capacitor and coupling resistor connected in series.

6. A hearing aid comprising:

a microphone;

a preamp and signal processing stage responsively coupled to said microphone;

an active low pass filter responsively coupled to said preamp and signal processing stage, said active low pass filter having an adjustable overshoot adapted to tunably match a measured resonance curve to provide a substantially smooth insertion gain frequency response, said active low pass filter including:

a resistor coupled to a capacitor to form a low pass filter to provide a filtered signal;

an operational amplifier to receive the filtered signal at an input of the operational amplifier; and a variable resistor to couple the low pass filter to the input of the operational amplifier such that the variable resistor controls a peak frequency of the low pass filter; and an output amplifier responsively coupled to said active low pass filter.

7. The hearing aid according to claim 6 wherein said output amplifier further comprises a class D amplifier.

8. The hearing aid according to claim 7 wherein said active low pass filter is adapted to provide a frequency of peak gain of the hearing aid at about 1.2 kilohertz.

9. The hearing aid according to claim 7 wherein said output amplifier is coupled to said active low pass filter by a buffering stage that is capacitively coupled to said active low pass filter.

10. The hearing aid according to claim 9 wherein said output amplifier is coupled to said buffering stage by a capacitor.

11. A method of assisting a hearing impaired patient comprising:

tuning a frequency response curve of an electronic hearing aid to a measured resonance curve of said hearing impaired patient such that the electronic hearing aid provides said hearing impaired patient with a smooth insertion frequency response, wherein said tuning includes adjusting a variable resistor coupled to an operational amplifier of an active low pass filter in the electronic hearing aid, the active low pass filter configured having;

a low pass filter to provide a filtered signal;

the operational amplifier to receive the filtered signal at an input of the operational amplifier; and the variable resistor coupling the low pass filter to the input of the operational amplifier such that the variable resistor controls a peak frequency of the low pass filter.

12. The method according to claim 11 wherein said electronic hearing aid further comprises a class D output amplifier.

13. The method according to claim 12 wherein said electronic hearing aid further comprises said active low pass filter responsively coupled to said class D output amplifier.

14. The method according to claim 13 wherein said tuning further comprises adjusting the overshoot of said active low pass filter to provide a frequency of peak gain of the electronic hearing aid at about 1.2 kilohertz.

15. The method according to claim 14 wherein said adjusting further comprises adjusting an amplification of an overshoot of said active low pass filter.

16. A hearing aid comprising:

means for converting an acoustic signal into an electrical signal;

means responsively coupled to said converting means for adjustably processing said electrical signal to produce a desired frequency response, said processing means having an active low pass filter adapted to tunably match a measured resonance curve to provide a substantially smooth insertion gain frequency response, said active low pass filter including:

a low pass filter to provide a filtered signal;

an operational amplifier to receive the filtered signal at an input of the operational amplifier; and a variable resistor to couple the low pass filter to the input of the operational amplifier such that the variable resistor controls frequency of peak gain in a frequency response of the hearing aid; and means responsively coupled to said processing means for amplifying said processed electrical signal.

17. The hearing aid according to claim 16 wherein said amplifying means further comprises a class D amplifier.

18. The hearing aid according to claim 17 wherein said processing means is adapted to provide a frequency of peak gain of the hearing aid at about 1.2 kilohertz.

19. The hearing aid according to claim 16 wherein said amplifying means is capacitively coupled to said processing means.

20. The hearing aid according to claim 16 wherein said amplifying means is coupled to said processing means through a buffering stage.

* * * * *